US011035110B1

(12) United States Patent
Wright et al.

(10) Patent No.: US 11,035,110 B1
(45) Date of Patent: Jun. 15, 2021

(54) DRAIN CATCH

(71) Applicants: Bruce Wright, Harrisburg, PA (US); Patrick Moffatt, Hershey, PA (US)

(72) Inventors: Bruce Wright, Harrisburg, PA (US); Patrick Moffatt, Hershey, PA (US)

( * ) Notice: Subject to any disclaimer, the term of this patent is extended or adjusted under 35 U.S.C. 154(b) by 0 days.

(21) Appl. No.: 16/693,916

(22) Filed: Nov. 25, 2019

(51) Int. Cl.
*E03C 1/264* (2006.01)

(52) U.S. Cl.
CPC ..... *E03C 1/264* (2013.01)

(58) Field of Classification Search
CPC .... E03C 1/23; E03C 2201/40; E03C 2201/80; E03C 1/26; E03C 1/264
USPC ..... 210/153
See application file for complete search history.

(56) References Cited

U.S. PATENT DOCUMENTS 1,361,243 A * 12/1920 Fuson ..... B01D 35/005 210/305
1,798,441 A 3/1931 Weiss
1,822,440 A * 9/1931 Jacobson ..... B01D 35/005 210/423
2,166,279 A * 7/1939 Barwick ..... E03C 1/29 210/94
2,331,055 A 10/1943 Smith
2,742,101 A * 4/1956 Stambaugh ..... E03C 1/284 137/247.41
3,596,294 A 8/1971 Hoffman
3,982,289 A 9/1976 Robbins
4,207,631 A 6/1980 Baggey
4,268,392 A * 5/1981 Hayes ..... E03C 1/264 210/238
4,700,412 A * 10/1987 Manuel ..... B01D 36/04 137/247.51
4,932,082 A 6/1990 Ridgeway
5,259,410 A 11/1993 Trueb
5,372,718 A * 12/1994 Zebian ..... B01D 29/117 210/301
5,525,215 A * 6/1996 Marchionda ..... A47J 37/1285 210/95
6,153,095 A 11/2000 Francisco
6,385,799 B1 * 5/2002 Doyen ..... E03C 1/284 137/242
2002/0194675 A1 * 12/2002 Weaver ..... E03C 1/23 4/688
2016/0184745 A1 * 6/2016 Haslauer ..... B01D 35/02 210/411

FOREIGN PATENT DOCUMENTS

KR 101242221 B1 3/2013

OTHER PUBLICATIONS

Shower Drain Refill Baskets, Plstic, Black. Product Listing [online]. © 2011-2019 Zoro Tools, Inc. [retrieved on May 10, 2019]. Retrieved from the Internet: <URL: https://www.zoro.com/danco-basketstrainer-d2-plastic-black-9d00010739/i/G2601000/feature-product?gclid=Cj0KCQjw4fHkBRDcARIsACV58_GhREu40EDnP5h5km7KIZXzDjwsiVPFJkzlorarxF545lkCuzdVkklaAuNZEALw_wcB>.

(Continued)

*Primary Examiner* — Nam X Nguyen
*Assistant Examiner* — Ekandra S. Miller-Cruz
(74) *Attorney, Agent, or Firm* — Cramer Patent & Design, PLLC; Aaron R. Cramer

(57) ABSTRACT

A drain catch has a cylindrical body having a lid and gasket. Secured within the body is a mesh tray. The body also includes a water inlet aperture and a water outlet aperture and is configured to secure about the trap of a sink drainpipe.

11 Claims, 5 Drawing Sheets

(56) References Cited

OTHER PUBLICATIONS

Elbow-shaped drainage trap. Patent Translation [online]. Google Patents. [retrieved on May 10, 2019]. Retrieved from the Internet: <URL: https://patents.google.com/patent/KR101242221B1/en?q=elbow&q=drains&oq=elbow+drains>.

* cited by examiner

DRAIN CATCH

RELATED APPLICATIONS

None.

FIELD OF THE INVENTION

The present invention relates generally to a drain catch and more specifically for a drain catch for a jeweler.

BACKGROUND OF THE INVENTION

One of life's common problems that most of us have experienced is that of a dropped item down a sink drain. Any small object can fall down a sink drain, thus causing grief for all involved. While the object is usually retrieved from the J or P trap below the sink, it is a worrisome and messy job to find out. First the pipe trap must be loosened by removing two large retaining nuts, which requires the use of tools. Next the trap is slid off, but of course it is filled with water which usually causes a spill and mess even if a bucket is used. Next the object is shaken out of the trap, and the trap reinstalled, and inspected for leaks. This procedure must be performed every time an object is dropped down the drain, thus causing wear and tear on the rest of the plumbing system as well.

Should one be performing jewelry work such as when sizing, creating, or resetting diamonds or other precious stones, or even working with precious metals, the task is made more complicated by the small size of the object, which in some cases can wash through the trap. Accordingly, there exists a need for a means by which very small items such as diamonds, precious stones, or pieces of precious metals can be retrieved from a sink trap without the problems as described above. The development of the sink drain capture device for small items fulfills this need.

SUMMARY OF THE INVENTION

In view of the foregoing disadvantages inherent in the prior art, it has been observed that there is need for a sink drain capture device, comprises a main cup body which is secured to a top plate via an internal holding bolt. The holding bolt is recessed within the main cup body and is mechanically affixed to a handle to allow for removal and replacement of the holding bolt. The main cup body provides an external sidewall and an internal sidewall. The device also comprises an inlet connection which has a respective threaded connection nut. The inlet connection is connected to a drain connection of a sink. The device also comprises an outlet connection which has a respective threaded connection nut. The inlet connection and the connection nut are arranged and spaced to form a standard P-trap and the outlet connection is connected to a drain outlet.

The circumference of the top plate may be bordered by the main cup body. The holding bolt may be inserted into a captive nut located in the middle of the top plate. The captive nut may be permanently affixed to the top plate. The captive nut may be permanently affixed to the top plate via a welding process or an adhesive bonding process. The lower enclosed portion of the main cup body may be provided with a micro screen. The holding bolt may be replaced by hand and may be made of material selected from the group consisting of corrosion resistant material, stainless steel material, or brass material.

The inlet connection may be provided with an intake shroud that provides for an intake water flow path that is generally parallel with the plate design of the top plate. The intake shroud may be intended to control wastewater flow through the sink drain capture device to allow for smooth drain operation. The outlet connection may be provided with an outtake shroud that may provide for an outtake water flow path that is generally parallel with the plate design of the top plate. The outtake shroud may be intended to control wastewater flow through the sink drain capture device to allow for smooth drain operation. One or more portions of the sink drain capture device that are exposed to flowing wastewater may be made of acid resistant polymer. The sink drain capture device may be suitable for new construction or may be installed in place of an existing P-trap during a retrofit project. A water-tight seal may be made between the main cup body and the top plate by a male protrusion around the perimeter of the top plate which mates with a female cavity in the external sidewall of the main cup body. A first O-ring may be provided within the female cavity to aid in water tightness while a second O-ring may be provided under the perimeter of the top plate and the male protrusion. The holding bolt as tightened and loosened by the handle may penetrate an internal sidewall and may be held captive by the captive nut.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
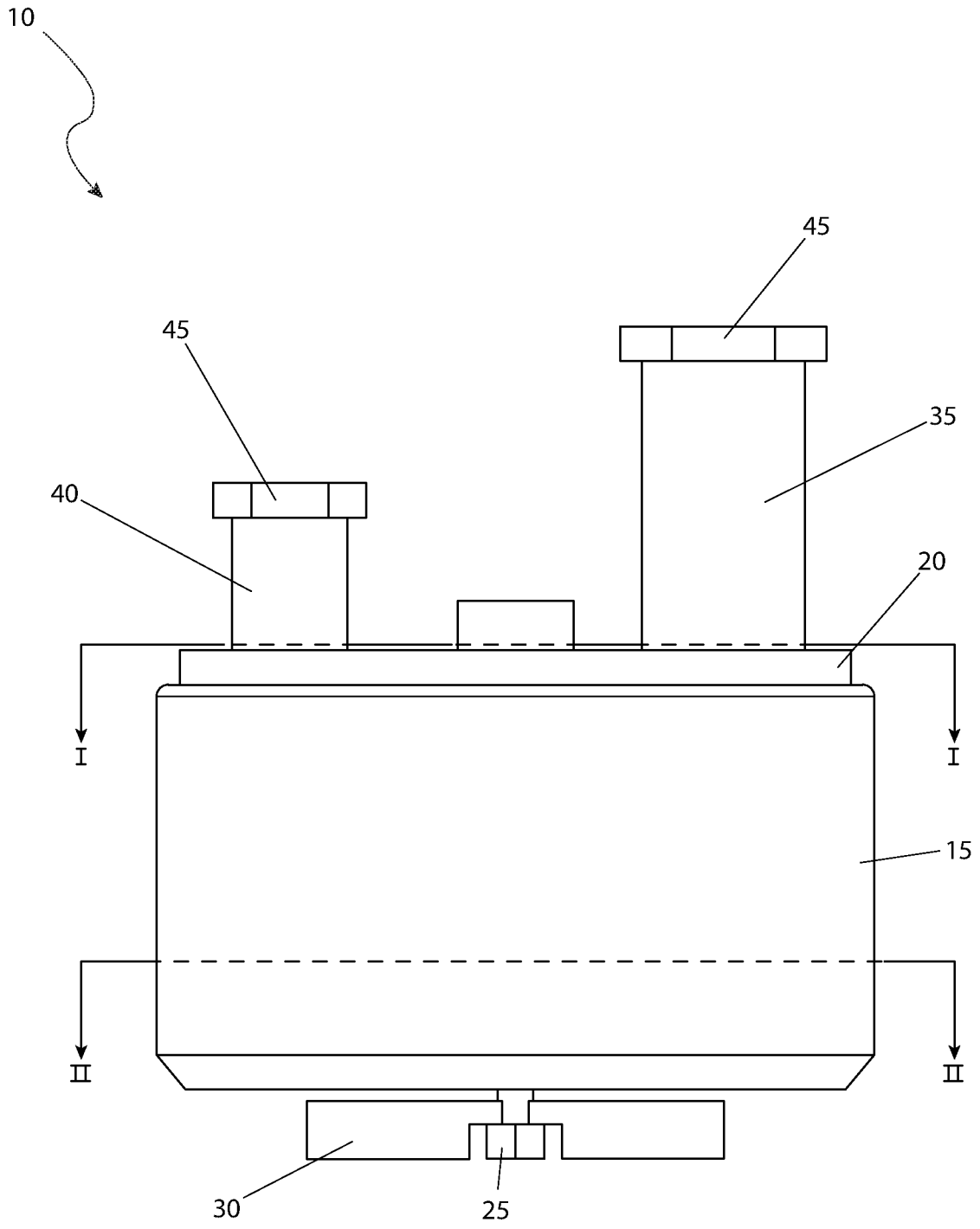
FIG. 1 is a side view of the sink drain capture device 10, according to the preferred embodiment of the present invention.

10 sink drain capture device
15 main cup body
20 top plate
25 holding bolt
30 handle
35 inlet connection
40 outlet connection
45 connection nut
50 drain connection
55 sink
60 drain outlet
65 intake shroud
70 intake water flow path "i"
75 outtake shroud
80 outtake water flow path "o"
85 captive nut

90 external sidewall
95 internal sidewall
100 void space
105 micro screen
110 cavity
115 male protrusion
120 female cavity
125 first O-ring
130 second O-ring

DESCRIPTION OF THE PREFERRED EMBODIMENTS

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a side view of the sink drain capture device 10, according to the preferred embodiment of the present invention is disclosed. The sink drain capture device (herein also described as the "device") 10, includes a main cup body 15 which is preferably cylindrical in shape. While the exact size of the main cup body 15 as well as all components of the device 10 can vary in size per the specific drain upon which it is used, it is envisioned that a standard residential or commercial utility sink would be approximately four inches (4 in.) in height and six to eight inches (6-8 in.) in diameter. As such, the exact dimension or final configuration of any component of the device 10 is not intended to be a limiting factor of the present invention.

The main cup body 15 is secured to a top plate 20, circular in nature, via an internal holding bolt 25. The internal configuration of the holding bolt 25 will be described herein below in greater detail. The holding bolt 25 is recessed within and mechanically affixed to a handle 30 to allow for removal and replacement of the holding bolt 25 by hand without any tools. The device 10 provides for an inlet connection 35 and an outlet connection 40 each with a respective threaded connection nut 45. The arrangement and spacing of the inlet connection 35 and connection nut 45 with respect to linear separation distance is intended to mimic that of a standard P-trap used in waste plumbing connections. All materials of the device 10 exposed to the flow of wastewater would be made of acid resistant polymer. Other components of the device 10 such as the holding bolt 25 would be made of corrosion resistant material such as stainless steel, brass, or the like.

Figure 2:
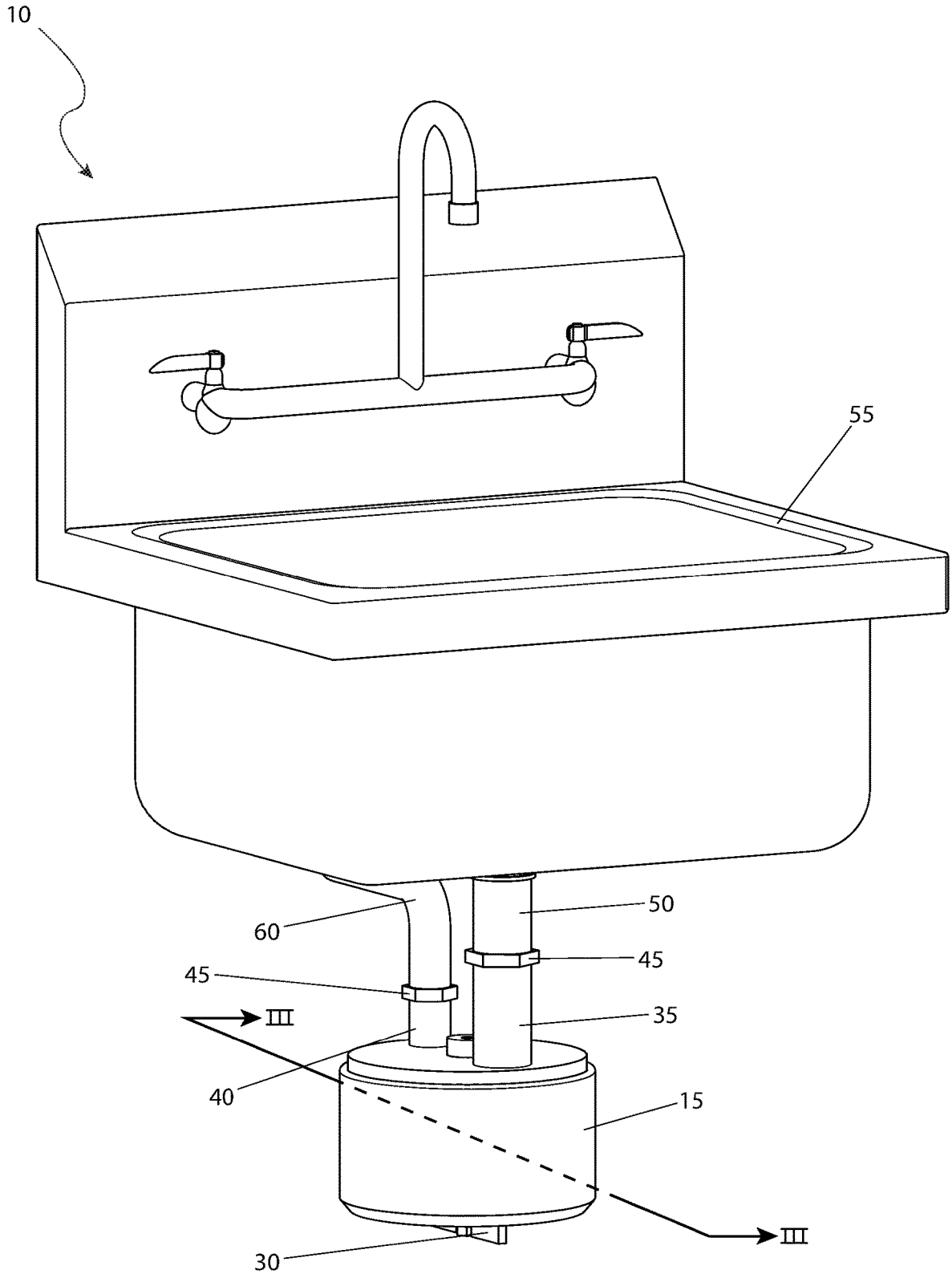
FIG. 2 is a perspective view of the sink drain capture device 10, shown in a utilized state, according to the preferred embodiment of the present invention.

Referring next to FIG. 2, a perspective view of the device 10, shown in a utilized state, according to the preferred embodiment of the present invention is depicted. This view discloses the device 10 installed on a drain connection 50 of a typical sink 55. The inlet connection 35 is connected to the drain connection 50, while the outlet connection 40 is connected to a drain outlet 60. The handle 30 is visible on the bottom of the main cup body 15. The device 10 is suitable for installation in an exposed manner as shown in FIG. 2, or maybe hidden from view when contained along with other plumbing connections in a vanity or cabinet. The connections made via the two (2) connection nuts 45 would be made via wrenches or slip joint pliers during the initial installation of the device 10. The device 10 is suitable for new construction or may be installed in place of an existing P-trap during a retrofit project. The installation effort is made with standard tools and is no more difficult than the installation associated with a standard P-trap.

Figure 3:
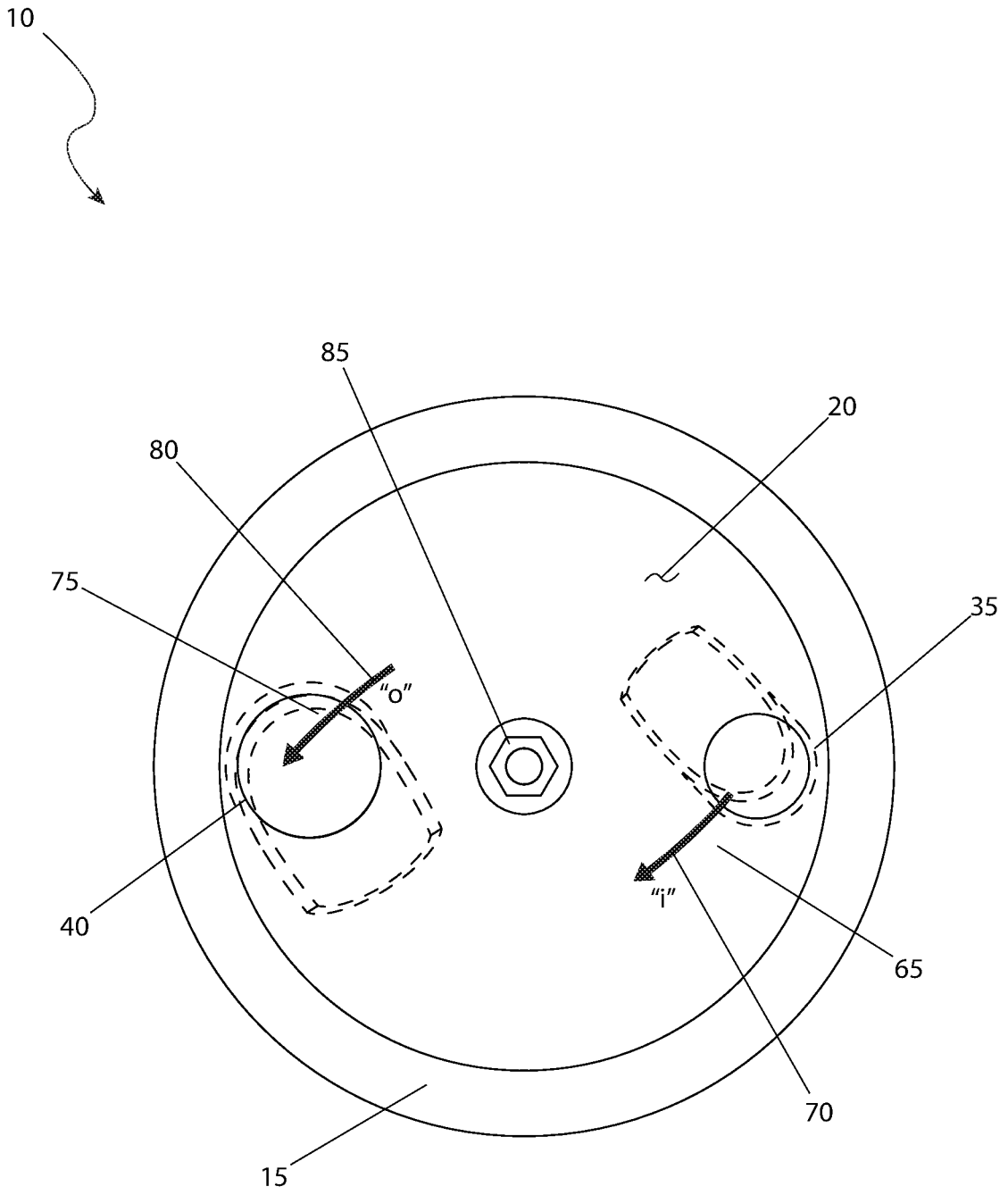
FIG. 3 is a sectional view of the sink drain capture device 10, as seen along a line I-I, as shown in FIG. 1, according to the preferred embodiment of the present invention.

Referring now to FIG. 3, a sectional view of the device 10, as seen along a line I-I, as shown in FIG. 1, according to the preferred embodiment of the present invention is shown. The circular penetration of the inlet connection 35 and the outlet connection 40 are shown into the top of the top plate 20. The circumference of the top plate 20 is bordered by the main cup body 15. The inlet connection 35 is provided with an intake shroud 65 (shown by dashed lines due to its hidden nature). The intake shroud 65 provides for an intake water flow path "i" 70 that is generally parallel with the plate design of the top plate 20. Likewise, the outlet connection 40 is provided with an outtake shroud 75 (shown by dashed lines due to its hidden nature). The outtake shroud 75 provides for an outtake water flow path "o" 80 that is generally parallel with the plate design of the top plate 20. Both the intake shroud 65 and the outtake shroud 75 are intended to control wastewater flow through the device 10 to allow for smooth drain operation. The holding bolt 25 is visible in the middle of a captive nut 85 located in the middle of the top plate 20. The captive nut 85 is permanently affixed to the top plate 20 in either a welding or adhesive bonding process.

Figure 4:
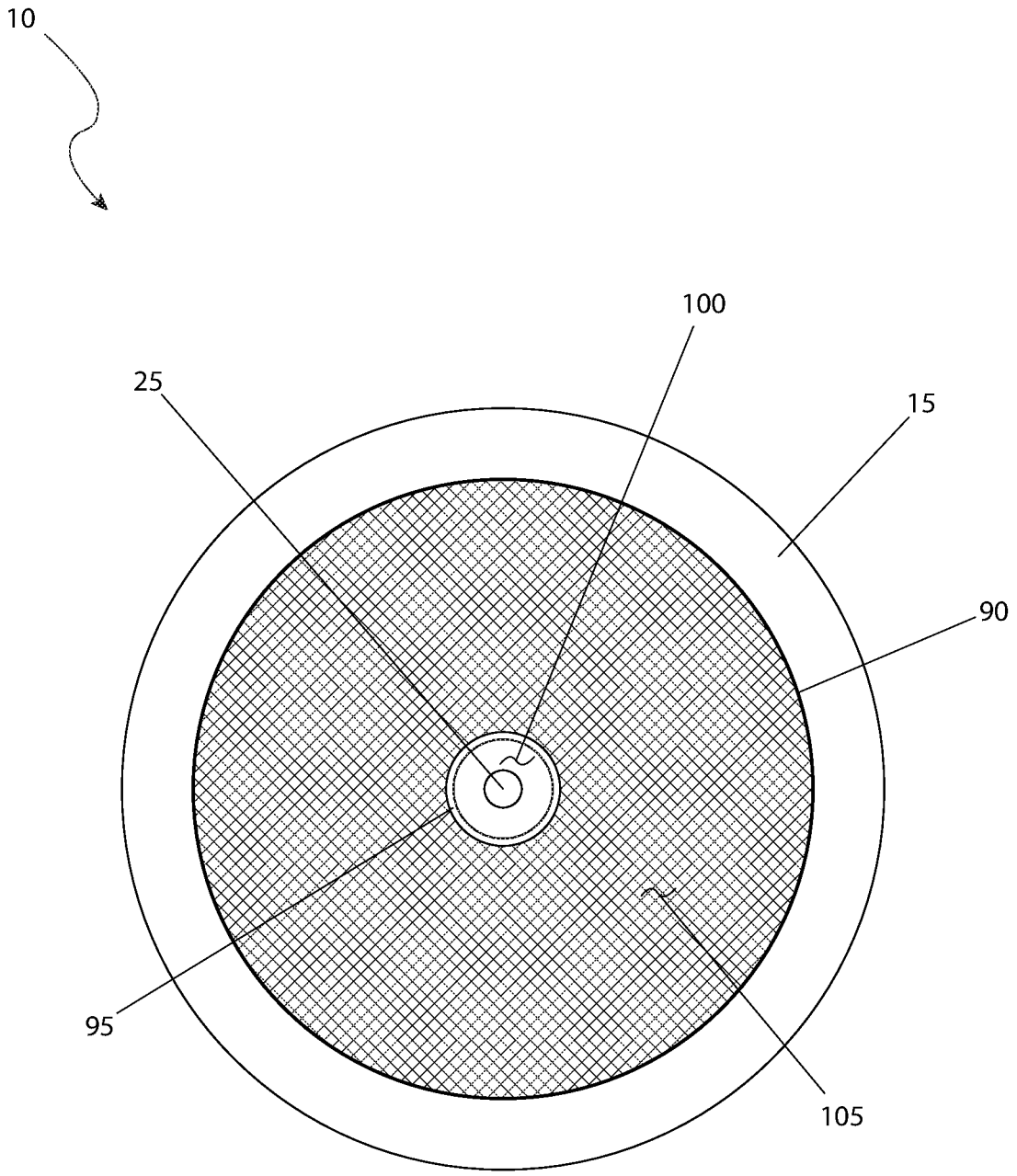
FIG. 4 is a sectional view of the sink drain capture device 10, as seen along a line II-II, as shown in FIG. 1, according to the preferred embodiment of the present invention; and, FIG. 5 is a sectional view of the sink drain capture device 10, as seen along a line III-III, as shown in FIG. 1, according to the preferred embodiment of the present invention.

Referring next to FIG. 4, a sectional view of the device 10, as seen along a line II-II, as shown in FIG. 1, according to the preferred embodiment of the present invention is disclosed. This view discloses the bottom section of the device 10. The main cup body 15 provides an external sidewall 90 as well as an internal sidewall 95. The holding bolt 25 is visible within the confines of the internal sidewall 95 and a void space 100. The lower enclosed portion of the main cup body 15 is provided with a micro screen 105 that is generally in the shape of an annulus. The micro screen 105 may or may not be removable from the bottom of the main cup body 15.

Figure 5:
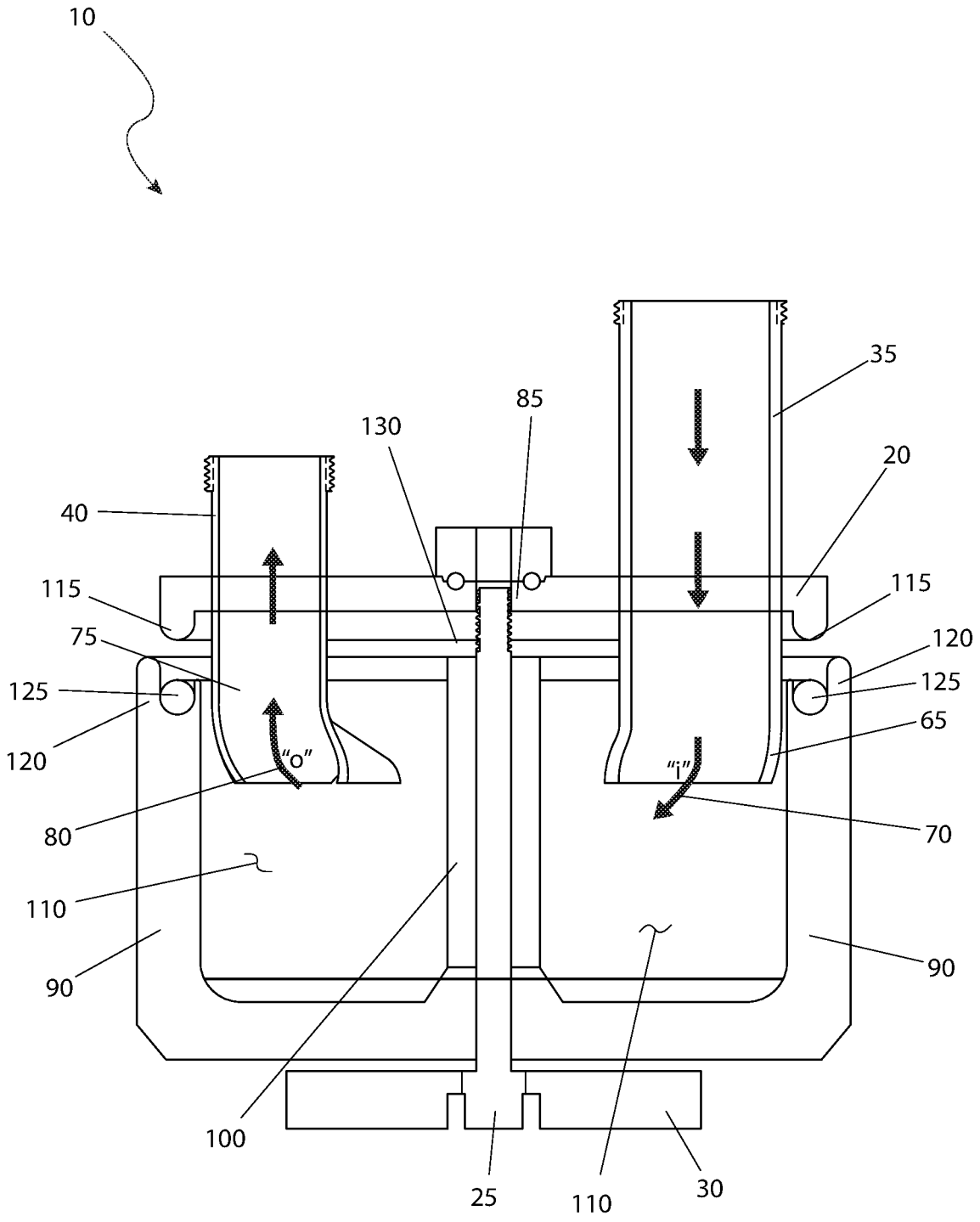

Referring to FIG. 5, a sectional view of the device 10, as seen along a line III-III, as shown in FIG. 1, according to the preferred embodiment of the present invention is depicted. It is noted that the main cup body 15 and the top plate 20 are shown partially disassembled for purposes of visual clarity. Wastewater flow enters the inlet connection 35 along an intake water flow path "i" 70 and is guided by the intake shroud 65. The water flow than circulates through the cavity 110 bordered by the bottom of the main cup body 15, the external sidewall 90, the internal sidewall 95 and the top plate 20. Any small items, specifically, precious stones such as diamonds, or precious metals such as gold, would be held captive by the micro screen 105 due to their heavier density and tendency to sink or "fall out of" the wastewater flow. The water then continues as an outtake water flow path "o"

80 and out of the outtake shroud 75 and the outlet connection 40. A water-tight seal is made between the main cup body 15 and the top plate 20, by a male protrusion 115 around the perimeter of the top plate 20 which mates with a female cavity 120 in the external sidewall 90 of the main cup body 15. A first O-ring 125 is provided within the female cavity 120 to aid in water tightness. The holding bolt 25, as tightened and loosened by the handle 30 penetrates the void space 100 of the internal sidewall 95 and is held captive by the captive nut 85. A second O-ring 130 provides water tightness between said components. The threaded nature of the holding bolt 25 and the captive nut 85 allow for varying degrees of tightness to prevent leakage.

2. Operation of the Preferred Embodiment

The preferred embodiment of the present invention can be utilized by the common user in a simple and effortless manner with little or no training. It is envisioned that the device 10 would be constructed in general accordance with FIG. 1 through FIG. 5. The user would procure the device 10 from conventional procurement channels such as hardware stores, home improvement stores, mechanical supply houses, mail order and internet supply houses and the like. Special attention would be paid to the overall size of the device 10, materials of construction, diameter of the inlet connection 35 and the connection nut 45 and similar physical parameters.

After procurement and prior to utilization, the device 10 would be installed in the following manner: the existing "p" trap, if part of an existing installation, would be removed following well-known plumbing repair principles. The device 10 would be installed in the place of the P-trap with the inlet connection 35 connected to the drain connection 50 and the outlet connection 40 connected to the drain outlet 60; the connection nut 45 would be tightened as appropriate. At this point in time, the device 10 is ready for utilization.

During utilization of the device 10, the following procedure would be initiated: operation of the sink 55 would continue in a transparent manner to the typical user without any outward signs of variation from a main cup body 15 equipped with a conventional P-trap; should any small object fall into the drain connection 50 of the sink 55, the water flow would be immediately stopped; the user would then loosen and remove the main cup body 15 by manipulation of the handle 30, thus removing the holding bolt 25 from the captive nut 85; the main cup body 15, being kept in a level state, would be searched for the said small object as captured by the micro screen 105; upon retrieval, the main cup body 15 would be reassembled onto the top plate 20 and the holding bolt 25 re-tightened. At this point in time, the device 10 resumes normal operation until the capture and removal services of the device 10 are needed again in a repeating manner.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A sink drain capture device, comprising:

a main cup body secured to a top plate via an internal holding bolt, the holding bolt is recessed within the main cup body and is mechanically affixed to a handle to allow for removal and replacement of the holding bolt, the main cup body provides an external sidewall and an internal sidewall;

an inlet connection having a first respective threaded connection nut, the inlet connection is connected to a drain connection of a sink; and an outlet connection having a second respective threaded connection nut, the inlet connection and the first respective threaded connection nut are arranged and spaced to form a standard P-trap and the outlet connection is connected to a drain outlet;

wherein the holding bolt is inserted into a captive nut located in the middle of the top plate;

wherein a lower enclosed portion of the main cup body is provided with a micro screen that is generally in the shape of an annulus via the internal holding bolt;

wherein the inlet connection is provided with an intake shroud that provides for an intake water flow path that is generally parallel with a plate design of the top plate;

wherein the outlet connection is provided with an outtake shroud that provides for an outtake water flow path that is generally parallel with the plate design of the top plate;

wherein a water-tight seal is made between the main cup body and the top plate by a male protrusion around the perimeter of the top plate which mates with a female cavity in the external sidewall of the main cup body;

further comprising a first O-ring provided within the female cavity to aid in water tightness; and further comprising a second O-ring provided under the perimeter of the top plate and the male protrusion.

2. The sink drain capture device according to claim 1, wherein the circumference of the top plate is bordered by the main cup body.

3. The sink drain capture device according to claim 1, wherein the captive nut is permanently affixed to the top plate.

4. The sink drain capture device according to claim 1, wherein the holding bolt is replaced by hand.

5. The sink drain capture device according to claim 1, wherein the holding bolt is made of material selected from the group consisting of corrosion resistant material, stainless steel material, or brass material.

6. The sink drain capture device according to claim 1, wherein the intake shroud is intended to control wastewater flow through the sink drain capture device to allow for smooth drain operation.

7. The sink drain capture device according to claim 1, wherein the outtake shroud is intended to control wastewater flow through the sink drain capture device to allow for smooth drain operation.

8. The sink drain capture device according to claim 1, wherein one or more portions of the sink drain capture device that are exposed to flowing wastewater are made of acid resistant polymer.

9. The sink drain capture device according to claim 1, wherein the sink drain capture device is for new construction.

10. The sink drain capture device according to claim 1, wherein the sink drain capture device is installed in place of the P-trap during a retrofit project.

11. The sink drain capture device according to claim 1, the holding bolt as tightened and loosened by the handle penetrates an internal sidewall and is held captive by the captive nut.

* * * * *